US006370215B1

(12) United States Patent
Pinto et al.

(10) Patent No.: US 6,370,215 B1
(45) Date of Patent: Apr. 9, 2002

(54) APPARATUS FOR FEEDING, COUNTING AND DISPENSING DISCRETE OBJECTS

(75) Inventors: Itzhak Pinto, Roxbury; Rodney Lester, Greenwich, both of CT (US)

(73) Assignee: Kirby-Lester, Inc., Stamford, CT (US)

( * ) Notice: Subject to any disclaimer, the term of this patent is extended or adjusted under 35 U.S.C. 154(b) by 0 days.

(21) Appl. No.: 09/548,421

(22) Filed: Apr. 13, 2000

(51) Int. Cl.[7] ..... G06M 11/00
(52) U.S. Cl. ..... 377/6; 377/7
(58) Field of Search ..... 377/6, 7

(56) References Cited

U.S. PATENT DOCUMENTS

| | | | | |
|---|---|---|---|---|
| 2,676,733 A | 4/1954 | Lober | 222/202 |
| 3,618,819 A | 11/1971 | Blackburn et al. | 221/2 |
| 4,661,917 A | 4/1987 | Haze et al. | 364/567 |
| 4,744,492 A | 5/1988 | Hackmann et al. | 221/204 |
| 4,809,880 A | 3/1989 | Stein | 221/204 |
| 4,932,559 A | 6/1990 | Stein | 221/7 |
| 5,154,316 A | 10/1992 | Holcomb et al. | 221/202 |
| 5,317,645 A | 5/1994 | Perozek et al. | 382/8 |
| 5,638,417 A | 6/1997 | Boyer et al. | 377/7 |
| 5,671,262 A | 9/1997 | Boyer et al. | 377/11 |
| 5,768,327 A | 6/1998 | Pinto et al. | 377/10 |

OTHER PUBLICATIONS

Product brochure from Kirby–Lester Inc. on the KL15df automatic tablet counter with product verification, 4 pages, 1999.

*Primary Examiner*—Margaret R. Wambach
(74) *Attorney, Agent, or Firm*—David P. Gordon; David S Jacobson; THomas A Gallagher

(57) ABSTRACT

An object feeding, counting, and dispensing device is provided which includes a feeding funnel having a pathway having an entrance into which discrete objects are provided and an exit, an object sensing system at the exit of the pathway, a dispensing funnel having an upper opening into which the objects are gravity fed after passing through the object sensing system and a relatively smaller lower opening, a vibration system which substantially silently vibrates the dispensing funnel in a horizontal plane, and preferably not a vertical plane, and a display indicating the number of object counted. According to a preferred aspect of the invention, the vibration system includes a weight, a motor coupled to the dispensing funnel which eccentrically rotates the weight through XY plane such that rotation of the weight creates forces in X and Y directions, and a system which cancels the force in one of the X and Y directions.

10 Claims, 4 Drawing Sheets

APPARATUS FOR FEEDING, COUNTING AND DISPENSING DISCRETE OBJECTS

BACKGROUND OF THE INVENTION

1. Field of the Invention

This invention relates broadly to a feeding, counting and dispensing apparatus. More particularly, this invention relates to a feeding and counting apparatus which uses vibration to control the flow of discrete items, such as tablets, being fed and counted.

2. State of the Art

Counters for counting tablets, capsules, caplets and the like ("tablets") have been known in the pharmaceutical industry for some time. It is generally the common goal of such counters to feed a collection of tablets in a manner which permits the tablets to be counted as they move past a sensor, such as an optical sensor.

Industrial pharmaceutical tablet counters are bulky and use a feed mechanism to transport large quantities of tablets to a counting system which counts the tablets. The counted tablets are then dispensed into a container. For example, a counter may be configured to count millions of tablets which are divided into individual containers of hundred tablets each. The industrial counters are typically very loud, employing large rotational or linear vibrators to feed the tablets to the counting system. Such vibrators are also complex in their structure and require special tuning for each system.

Counters used in pharmacy environment are generally different from those used in industrial applications. In a pharmacy, a pharmacist is required to count different quantities of different tablets in succession. For example, a pharmacist may count 30 caplets of a heart medication for one patient and then count 60 tablets of an allergy medication for the next patient using the same counter. Therefor, a pharmacy tablet counter must be able to rapidly count many different types of tablets and must be capable of ensuring that medications of different prescriptions are not mixed due to tablets from a prior prescriptions unintentionally remaining in the counter. Clearing the counter is essential, as it is important to reduce the risk of cross contamination. In addition, behind a pharmacy counter, space is typically crowded and at a premium. Therefor, the counter should be compact rather than bulky. Moreover, pharmacy counter should be substantially silent.

As a result, a quiet feed system is preferred for pharmacy tablet counters. One relatively quiet system is a simple gravity system, in which a pharmacist dispenses tablets in bulk into a plastic funnel, and the force of gravity moves the tablets through that funnel and past a counter sensor, and then through a second funnel with a narrow bottom opening. However, simple gravity feed systems have a substantial drawbacks. Funneling the objects through a small opening may result in clogging of the opening, and therefore requires safety features to ensure that clogging has not occurred. In addition, static electricity can build up between the funnel and the tablets (and in particular light weight capsules), causing them to stick to the funnel in spite of the gravitational force. This can obviously cause serious problems.

As such, many counters count tablets into a tray, and the tablets are then transferred from the tray to a prescription bottle. The tray is used to visually inspect the counted tablets to ensure that no tablets from a previous prescription was inadvertently left in the counter, later dislodged from the counter, and incorrectly provided to the wrong patient. Such could result in injury to the patient receiving the incorrect medication and liability for the pharmacy. However, the use of tray is undesirable as it adds an extra step in every prescription which is counted: the transfer of the tablets from the tray to a prescription bottle.

Therefore, there has been an effort to develop a system which overcomes the problem of stuck tablets and which does not require the intermediate use of a tray. One proposed manner to prevent the static electricity build up is to use a funnel which is made of metal, e.g., stainless steel, and thereby prevents static electricity build up between the tablets and the funnel. However, tablets bouncing off the walls and through a stainless steel funnel tend to make substantially more noise than can be comfortably accommodated in a pharmacy.

SUMMARY OF THE INVENTION

It is therefor an object of the invention to provide a device for counting discrete objects which safely dispenses the objects directly into a container and reduces the risk of any objects remaining in the device.

It is another object of the invention to provide a counting device, which requires no special tuning operation applied to each manufactured device, has few parts, and functions with high reliability.

It is another object of the invention to provide a counting and dispensing device having substantially silent counting and dispensing systems.

In accord with these objects, which will be discussed in detail below, an object counting device is provided which includes a feeding funnel, an object sensing system which senses objects provided into the feeding funnel, a dispensing funnel having an upper opening into which the objects are gravity fed after passing through the object sensing system and a relatively smaller lower opening, a vibration system which substantially silently vibrates the dispensing funnel solely in a horizontal plane, and counter and display system indicating the number of objects counted.

According to a preferred aspect of the invention, the vibration system includes a first weight, a rotating means for eccentrically rotating the first weight in an XY plane such that a rotation of the weight creates forces applied to the rotating means in all directions in the XY plane, and means for transferring the force in only one of the X and Y directions to the dispensing funnel, that direction preferably being a horizontal direction. Such arrangement minimizes the overall noise level, and reduces the number of parts.

According to the first embodiment of the invention, the vibrating system comprises a resilient vertical support for the dispensing funnel, a weight, a motor, a mounting block, and a resilient horizontal support. The weight is coupled to the motor, the motor is mounted on the mounting block, the mounting block is attached to one end of the resilient horizontal support, and the dispensing funnel is attached to the second end of the resilient horizontal support. The motor is adapted to rotate the weight in an eccentric manner to create vertical (Y) and horizontal (X) forces applied to the motor and consequently to the mounting block. When the weight is rotated, the resilient horizontal support flexes to substantially silently absorb all vertical forces created by the weight and thereby prevents the transfer of such vibration forces to the dispensing funnel. The dispensing funnel therefore vibrates substantially smoothly, reliably and silently in a horizontal direction, evacuating the discrete objects provided therein.

According to a second embodiment of the invention, two weights are counter rotated in a horizontal plane XZ. The weights rotate about their respective axes which are displaced along the Z direction, wherein X, Y and Z are perpendicular. The counter rotation of the weights cancels the total force applied to the vibrating system in the Z direction. The desired force in X direction is transferred to the dispensing funnel to smoothly and silently vibrate the dispensing funnel in the X direction.

Additional objects and advantages of the invention will become apparent to the skilled in the art upon reference to the detailed description taken in conjunction with the provided figures.

DETAILED DESCRIPTION OF THE PREFERRED EMBODIMENTS

Figure 1:
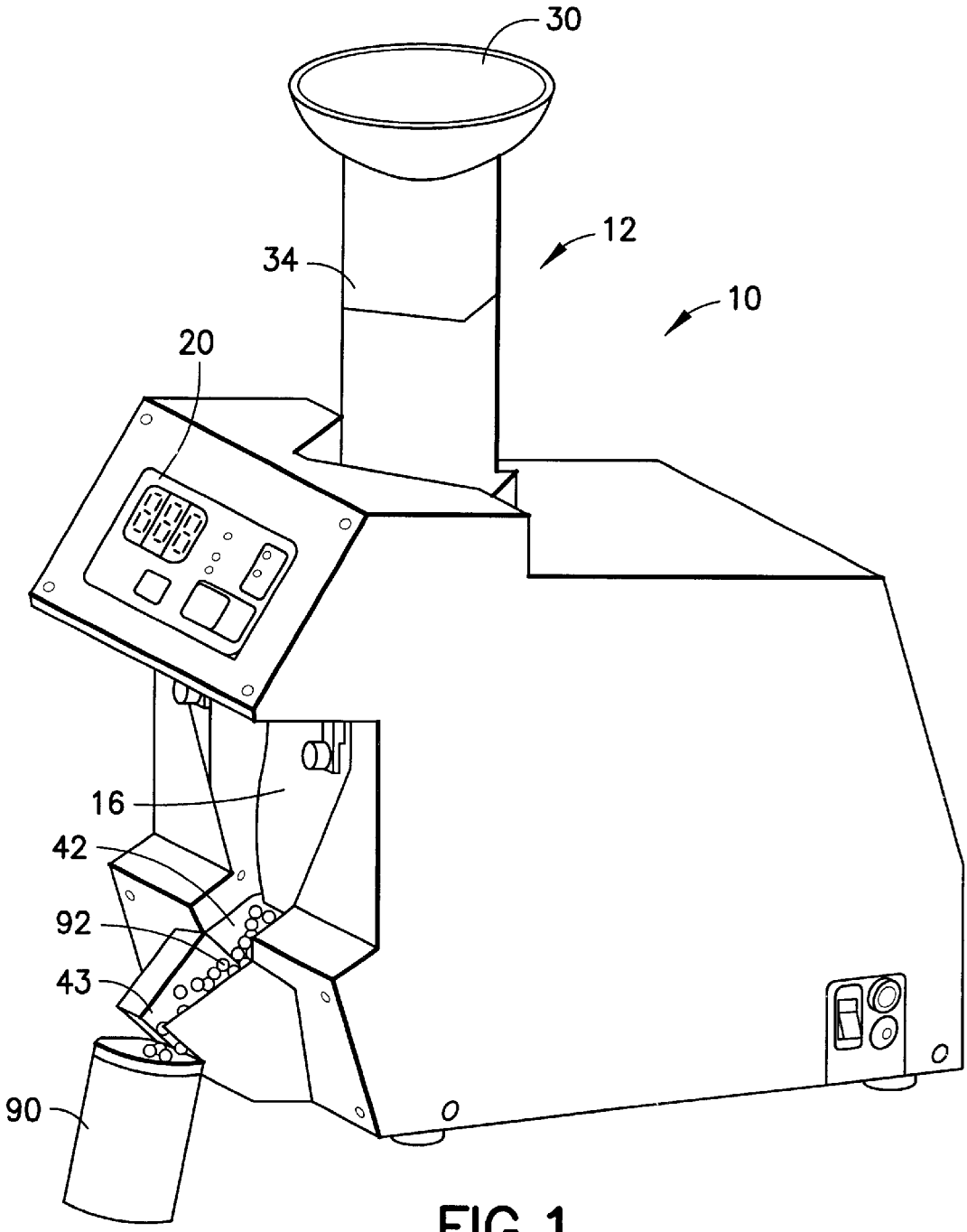
FIG. 1 is a side perspective view of a device for feeding, counting, and dispensing discrete objects according to the invention, and the container into which the discrete objects are dispensed.
Figure 2:
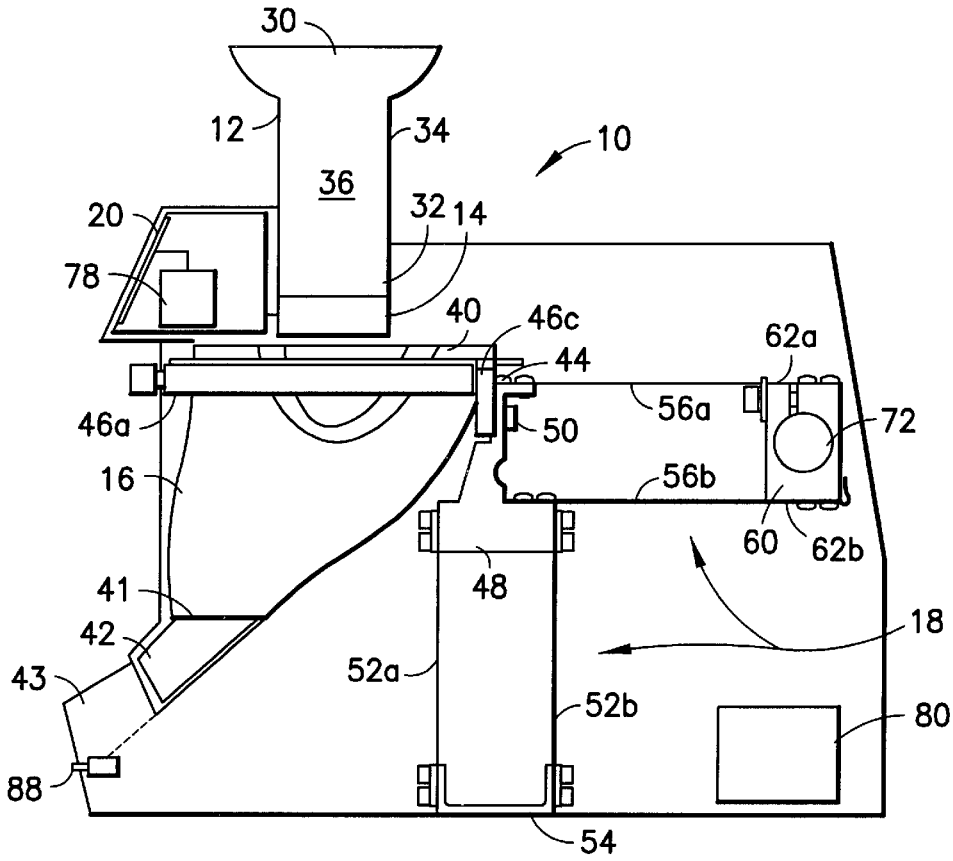
FIG. 2 is a schematic side view of the device in FIG. 1 according to the first embodiment of the invention.
Figure 3:
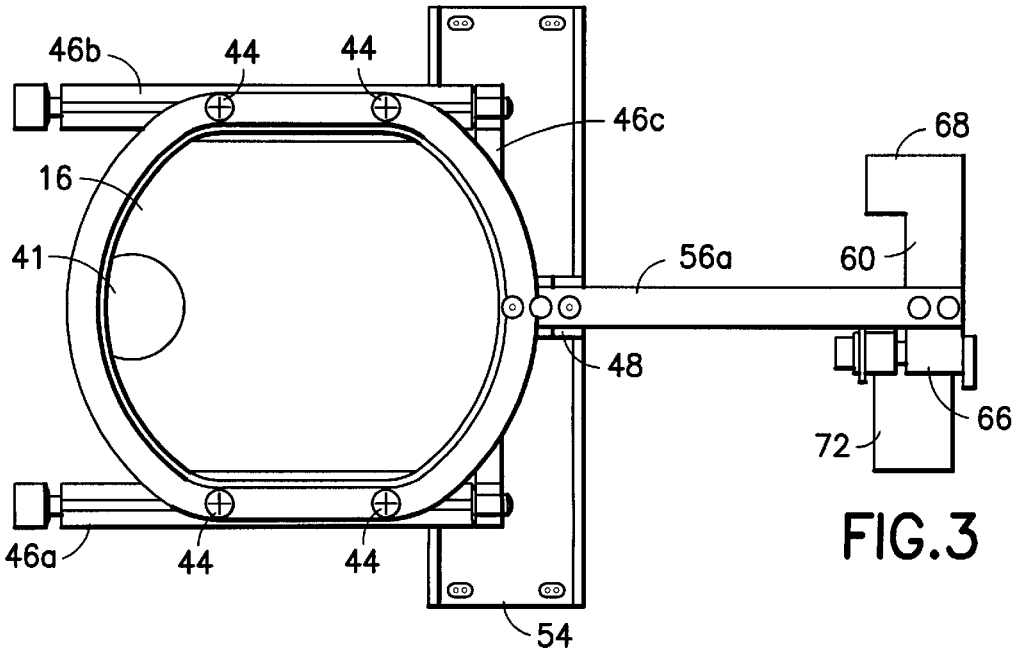
FIG. 3 is a schematic top view of the silent vibration system of the device in FIG. 1 according to the first embodiment of the invention.
Figure 4:
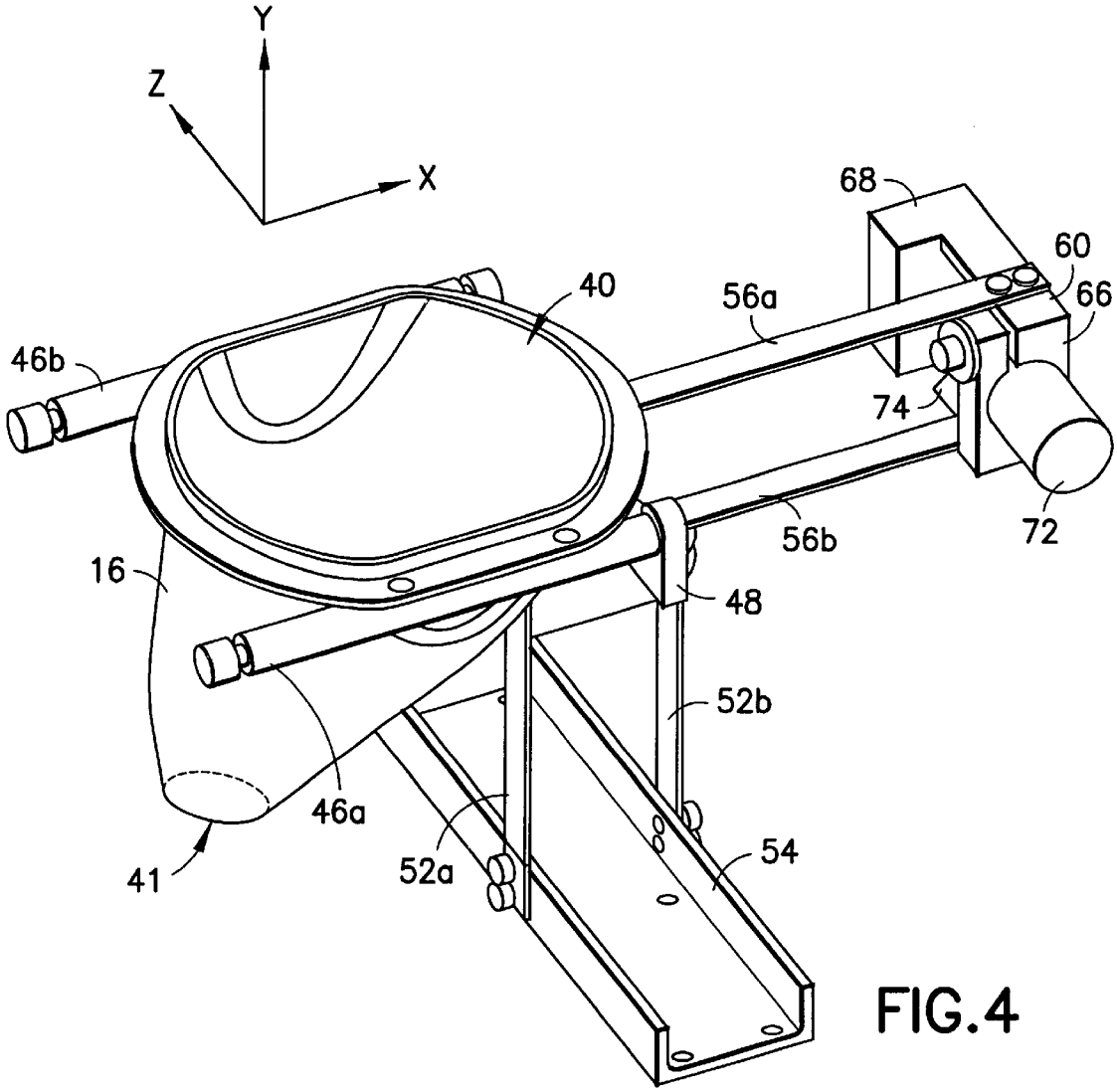
FIG. 4 is an isometric view of the silent vibration system of the device in FIG. 1 according to the first embodiment of the invention.
Figure 5:
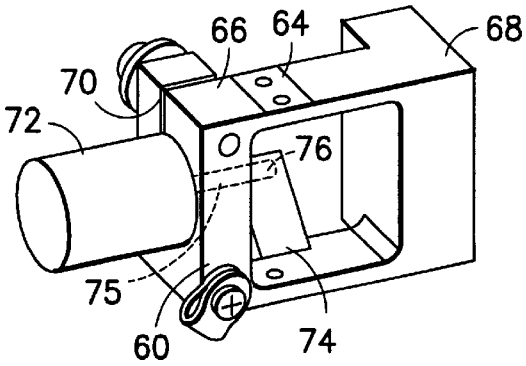
FIG. 5 is an isometric rear view of the mounting block provided with the motor for rotating an the eccentrically mounted weight, such components being part of the vibration system of the device in FIG. 1 according to the first embodiment of the invention.

Turning now to FIGS. 1 and 2, according to a preferred embodiment of the invention, an object counting device 10 includes a feeding funnel 12, an object sensing system 14, a dispensing funnel 16, a vibration system 18, a micro controller system 78 and a display 20.

The feeding funnel 12 is preferably plastic and includes an upper frustoconical portion 30 into which tablets and other discrete objects may be poured or otherwise provided, an exit 32, and a generally vertical portion 34 defining a pathway 36 between the frustoconical portion 30 and the exit 32.

The object sensing system 14, the microcontroller system 78, and the display 20 are arranged to count the objects as they move through the sensing area. These are preferably the same as or similar to those disclosed in co-owned U.S. Pat. Nos. 5,786,327 or 5,317,645. Alternatively, they may include or be substituted by any other systems for counting discrete objects which are known in the art.

Referring now to FIGS. 1 through 4, the dispensing funnel 16 is preferably plastic and has an upper opening 40 into which the discrete objects are received after falling through the object sensing system 14. Funnel 16 has a relatively smaller lower opening 41. Preferably, the lower opening 41 is non-axial with the upper opening 40, and the lower opening 41 is preferably provided toward a front portion of the device 10. A mechanical shutter 42 is preferably provided adjacent the lower opening 41 for retaining the objects in the funnel during the counting process, and for directing the objects for exiting the funnel thereafter and for sliding down through a chute 43 into a container 90.

The dispensing funnel 16 is coupled to the vibration system 18 which operates to substantially silently and reliably vibrate the dispensing funnel 16 preferably in a horizontal plane only. To that effect, the dispensing funnel 16 is fixedly coupled preferably via the use of screws 44 to rigid frame members 46*a,* 46*b,* 46*c,* and frame member 46*c* is fixedly coupled to a support block 48 by screws 50. The support block 48, and therefor the dispensing funnel 16, are rigidly coupled to and supported by a first pair of resilient, preferably spring steel supports 52*a,* 52*b*. The supports 52*a,* 52*b* are rigidly mounted in a substantially vertical orientation to a base 54. A second pair of resilient spring supports 56*a,* 56*b* are rigidly mounted in a substantially horizontal orientation to extend from a rear side of the support block 48.

Referring to FIGS. 2 through 5, a mounting block 60 is coupled between the rearward ends 62*a,* 62*b* of metal supports 56*a* and 56*b* in upper and lower mounting channels 64 which demarcate first and second sides 66, 68 of the mounting block 60. The first and second sides 66, 68 of the mounting block 60 are asymmetrically weighted about the mounting channels 64, with the second side 68 having greater mass than the first side 66. The first side 66 of the mounting block 60 includes a motor mount 70 in which a motor 72 is coupled. The motor 72 includes an axle 75 to which a weight 74 is coupled. The motor 72 and weight 74 are assembled such that rotation of the axle 75 of the motor 72 eccentrically rotates the weight 74 through a plane. According to the first embodiment of the invention, the motor 72 is oriented such that the plane of rotation is parallel to both the first and the second pairs of metal supports 52*a,* 52*b,* 56*a,* 56*b*. The weight 74 preferably has the shape of a 90 degree sector. The mounting block 60, with the motor 72 and weight 74 coupled thereto, is adapted to be balanced in weight about the mounting channel 64 on the metal supports 56*a,* 56*b*.

When the weight 74 is rotated by the motor 72, the eccentricity of the rotation generates horizontal (X) and vertical (Y) forces applied to the mounting block 60. The vertical forces generate vertical movement of block 60, as the resilient horizontal supports 56*a,* 56*b* substantially allow such movement to occur. As such, the dispensing funnel 16 does not receive forces in a vertical direction. However, the horizontal supports 56*a,* 56*b* cannot absorb the horizontal front-to-back force, and the horizontal force is transmitted to the support block 48 which, in turn, transmits the force to the dispensing funnel 16 and to the resilient vertical supports 52*a,* 52*b*. The resilient vertical supports 52*a,* 52*b* respond by bending forward or rearward, i.e., in the horizontal direction (X), and the funnel 16 moves along that direction. That is, rotation of a the weight 74 creates forces in both horizontal (X) and vertical (Y) directions, and the force in the vertical (Y) direction is canceled, while the force in the horizontal direction (X) is transferred to the dispensing funnel 16. The motor 72 preferably rotates the weight 74 at a speed above the natural frequency of the vibratory system 18. In addition, since the motor 72 is adapted to rotate relatively rapidly, e.g., 1800 rpm, and above the natural frequency, the movement in the horizontal plane is a harmonic vibratory movement. The amplitude of such vibration is a function of the mass and the mass distribution of the weight 74 about the axle 75, and the weight of the dispensing funnel 16 and all the other horizontally vibrating components of the system. The vibrating movement of the dispensing funnel 16 is reliable and substantially silent. This movement operates to efficiently and reliably evacuate the dispensing funnel 16 of any discreet objects provided therein.

Turning back to FIGS. 1 and 2, the display 20 indicates the number of objects sensed (counted). The display 20 is coupled to the micro controller system 78 which is coupled to the object sensing system 14. A power supply 80 is electrically coupled to the display 20, and to the microcontroller system 78. A switch 88 is located under the exit of chute 43 and is coupled to microcontroller system 78. Switch 88 detects the presence of the container 90, and sends a corresponding signal to the microcontroller system 78. Upon reception of that signal, microcontroller system 78 activates motor 72. Therefor, by placement of the container 90 at the exit of chute 43, dispensing funnel 16 is activated to vibrate and to evacuate the objects therein.

In use, if it is desired to count one hundred tablets 92 into a container 90, an amount of tablets is provided into the feeding funnel 12. The tablets 92 pass through and exit the pathway 36, where they are sensed by the sensing system 14, and counted by the microcontroller system 78. The display 20 shows the counted amount. The tablets then enter the dispensing funnel 16 through the upper opening 40 thereof, and are accumulated at the bottom of the funnel exit 41. Note that during counting the shutter 42 is in its upper (closed) position, thereby covering the funnel exit 41. Following the completion of the counting, the container 90 is placed adjacent to exit chute 43 so that it activates the switch 88. The microcontroller 78 then activates the shutter 42 to flip to its lower (open) position, and drives motor 72, which causes the vibrating system 18 to vibrate the dispensing funnel 16. The vibration of the dispensing funnel 16 prevents tablets 92 from remaining within the dispensing funnel 16, ensuring complete evacuation thereof. Once the tablets 92 exit the lower opening 41 of the dispensing funnel 16, they are directed by the shutter 42 toward the chute 43.

Figure 6:
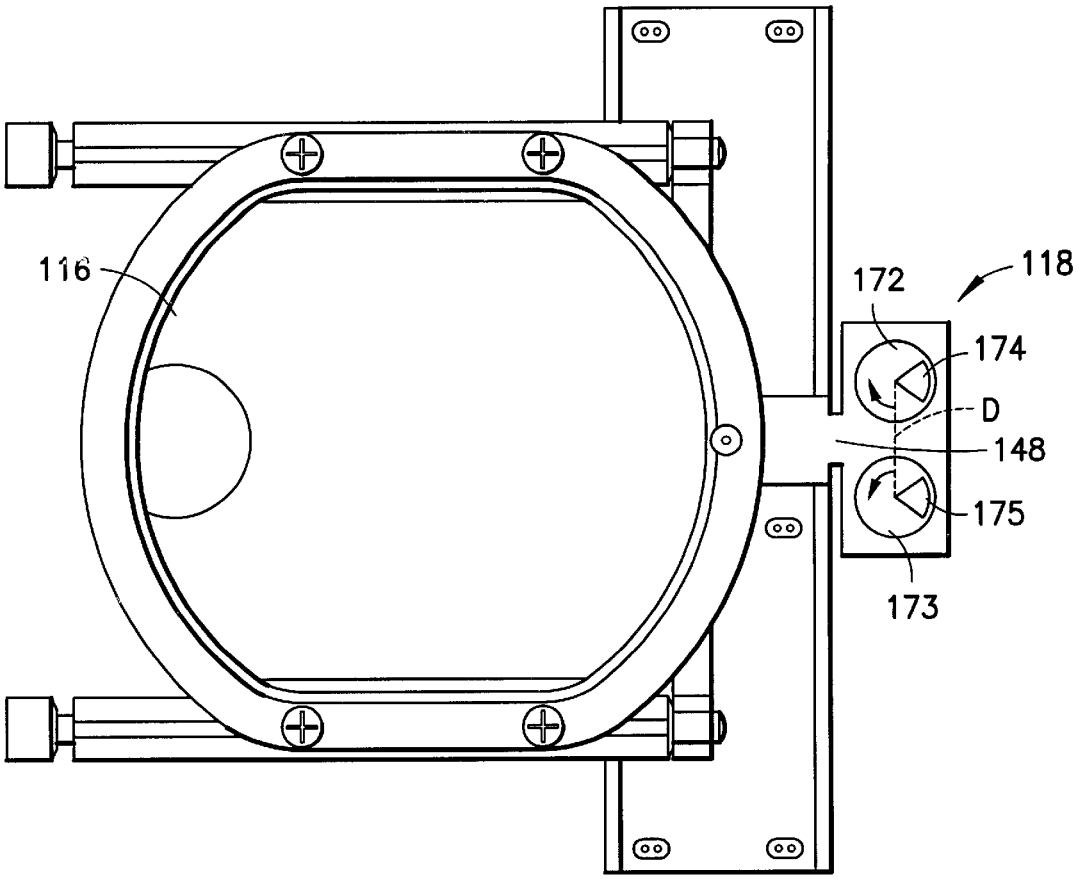
FIG. 6 is a schematic top view of the silent vibration system according to a second embodiment of a device for feeding, counting, and dispensing discrete objects according to the invention.

Turning now to FIG. 6, the object counting device may be provided with a second embodiment of a vibratory system 118. The vibratory system 118, generally similar to vibratory system 18, includes a support block 148 which is coupled to a dispensing funnel 116 and which is also coupled to a pair of vertical support members (not shown). According to the second embodiment, the support block 148 is provided with a first and second motors 172, 173, arranged to rotate respective weights 174, 175 in a horizontal plane about respective first and second axes separated by a segment D which lies in the horizontal plane. The weights 174, 175 are rotated in opposite directions and at equal speeds (i.e., at angular velocities of the same absolute value), such that both weights move in phase in the X direction and out of phase in the Z direction. The X direction lies in the horizontal plane and segment D is perpendicular to the X direction.

Because of the arrangement of the weights, all forces in the Z direction applied to block 148 from rotation of the weights will be canceled, as opposite forces are provided by the rotation of each weight along that direction. However, the forces applied to the block 148 in the X direction, i.e., backward and forward are transferred to the dispensing funnel 116, resulting in a silent and smooth vibration of the dispensing funnel 116.

There have been described and illustrated herein two embodiments of an object feeding, counting, and dispensing device. While particular embodiments of the invention have been described, it is not intended that the invention be limited thereto, as it is intended that the invention be as broad in scope as the art will allow and the specification be read likewise.

Thus, while particular materials have been disclosed, it will be appreciated that other materials can be used as well. In addition, while the sensing system has been described as being located at the exit of a feeding funnel, it will be appreciated that the sensing system may be provided within the feeding funnel or elsewhere. Furthermore while particular types of counting systems have been disclosed, it will be understood that other counting systems can be used. Also, while a sector-shaped weight is preferred, it will be recognized that weights of other shapes can be used. Moreover, while particular configurations have been disclosed in reference to the support members, it will be appreciated that a single support member or more then two support members, metal or non metal, can be used. Furthermore, while two motor-weight vibratory system configurations have been disclosed, it will be understood that other motor-weight configurations can be similarly used. For example, in the systems with two weights, it will be appreciated that a single motor may be used to rotate both weights where the two weights are mounted on rotating disks with an appropriate intermeshing gear system. In addition, while it is preferable to vibrate the dispensing funnel in the front-to-back horizontal direction, it will be appreciated that the vibration system will perform its desired function with vibration in the transverse horizontal direction. It will therefore be appreciated by those skilled in the art that yet other modifications could be made to the provided invention without deviating from its spirit and scope as so claimed.

What is claimed is:

1. An object counting device for counting and dispensing discrete objects, comprising:

a) a counting means for counting said discrete objects;

b) a dispensing funnel into which said discrete objects are provided after being counted by said counting means, said dispensing funnel having an exit through which said discrete objects are dispensed; and c) a vibration means for vibrating said dispensing funnel.

2. An object counting device according to claim 1, wherein:

said vibration means includes, i) a first weight rotating in an XY plane, said XY plane is defined by X and Y directions, said X and Y directions being perpendicular to each other, and ii) a first rotating means for eccentrically rotating said first weight.

3. An object counting device according to claim 2, wherein:

said vibration means is arranged to vibrate said dispensing funnel along substantially only one of said X and Y directions.

4. An object counting device according to claim 3, wherein:

said vibration means includes at least one resilient support coupled between said dispensing funnel and said first rotating means.

5. An object counting device according to claim 1, wherein:

said dispensing funnel is supported by at least one resilient support member.

6. An object counting device according to claim 2, wherein:

said X direction is horizontal and said Y direction is vertical.

7. An object counting device according to claim 6, wherein:

said vibration means is arranged to vibrate said dispensing funnel substantially along said X direction.

8. An object counting device for counting and dispensing discrete objects, comprising:

a) a counting means for counting said discrete objects;

b) a dispensing funnel into which said discrete objects are provided after being counted by said counting means, said dispensing funnel having an exit through which said discrete objects are dispensed; and c) a vibration means for vibrating said dispensing funnel, said vibration means including, i) a first weight rotating in an XZ plane, said XZ plane is defined by X and Z directions which are perpendicular to each other, ii) a first rotating means for eccentrically rotating said first weight, iii) a second weight rotating in said XZ plane, and iv) a second rotating means for eccentrically rotating said second weight.

9. An object counting device according to claim 8, wherein:

said first weight rotates about a first axis, said second weight rotates about a second axis, said first and second weights have a same mass distribution about their respective first and second axes, and said first and second axes are displaced from each other by a segment D, wherein said segment D lies within said XZ plane, said first and second weights rotate oppositely and at angular velocities of a same absolute value, and said first and second weights oscillate in phase in one direction.

10. An object counting device according to claim 9, wherein:

said X direction is horizontal and said segment D is perpendicular to said X direction.

* * * * *